US009266378B2

(12) United States Patent
Cenzano

(10) Patent No.: US 9,266,378 B2
(45) Date of Patent: Feb. 23, 2016

(54) CONNECTED DISK BINDING MECHANISM

(71) Applicant: R.R. DONNELLEY & SONS COMPANY, Chicago, IL (US)

(72) Inventor: Lauren Cenzano, East Northport, NY (US)

(73) Assignee: R. R. Donnelley & Sons Company, Chicago, IL (US)

( * ) Notice: Subject to any disclaimer, the term of this patent is extended or adjusted under 35 U.S.C. 154(b) by 0 days.

(21) Appl. No.: 14/354,122

(22) PCT Filed: Oct. 29, 2012

(86) PCT No.: PCT/US2012/062455

§ 371 (c)(1),
(2) Date: Apr. 24, 2014

(87) PCT Pub. No.: WO2013/063589

PCT Pub. Date: May 2, 2013

(65) Prior Publication Data

US 2014/0294481 A1 Oct. 2, 2014

Related U.S. Application Data

(60) Provisional application No. 61/552,239, filed on Oct. 27, 2011.

(51) Int. Cl.
*B42F 3/00* (2006.01)
*B42F 21/02* (2006.01)
(Continued)

(52) U.S. Cl.
CPC ... *B42F 3/00* (2013.01); *B42D 5/00* (2013.01); *B42F 3/003* (2013.01); *B42F 3/04* (2013.01); *B42F 5/00* (2013.01); *B42F 13/0093* (2013.01); *B42F 21/02* (2013.01)

(58) Field of Classification Search
CPC ..... B42F 13/0093; B42F 5/00; B42F 21/02; B42F 3/003
USPC ..... 281/27.1, 27.2; 402/79, 501; D19/27
See application file for complete search history.

(56) References Cited

U.S. PATENT DOCUMENTS 2,084,552 A * 6/1937 Del Camp ..... 281/27.2
5,553,959 A * 9/1996 Feldman et al. ..... 402/79
(Continued)

FOREIGN PATENT DOCUMENTS

CN 2600251 1/2001
CN 201026728 2/2008
(Continued)

OTHER PUBLICATIONS

State Intellectual Property Office of P.R.C. "First Office Action", issued in connection with application No. 201280065281.8, issued on Jul. 27, 2015, (13 pages).

*Primary Examiner* — Kyle Grabowski
(74) *Attorney, Agent, or Firm* — Hanley, Flight & Zimmerman, LLC

(57) ABSTRACT

A binding member, including a first disk ring portion configured for reception in a binding recess of a sheet member. The first disk ring portion can have an inner surface that faces radially inward for engaging and retaining a first binding protrusion of a sheet member for binding the sheet member. The first disk ring portion can be configured for allowing the bound sheet members to slide around the first disk ring portion while retaining the engagement. The binding member can also have an axial extension member associated with the first disk ring portion and extending generally in an axial direction with respect thereto.

15 Claims, 9 Drawing Sheets

(51) Int. Cl.

| | |
|---|---|
| ***B42F 5/00*** | (2006.01) |
| ***B42F 13/00*** | (2006.01) |
| ***B42D 5/00*** | (2006.01) |
| ***B42F 3/04*** | (2006.01) |

(56) References Cited

U.S. PATENT DOCUMENTS 6,364,560 B1 * 4/2002 Lin ..... 402/79
2004/0251677 A1 12/2004 Tseng

FOREIGN PATENT DOCUMENTS

| | | | |
|---|---|---|---|
| DE | 202004003041 | | 6/2004 |
| EP | 1072439 | * | 1/2001 |
| FR | 2738530 | | 3/1997 |
| JP | 2001096967 | | 4/2001 |
| JP | 2003-191675 | A | 7/2003 |
| KR | 10-2011-0045192 | A | 5/2011 |

* cited by examiner

CONNECTED DISK BINDING MECHANISM

CROSS-REFERENCE TO RELATED APPLICATIONS

This application is the national stage application of International patent application No. PCT/US2012/062455, entitled "Connected Disk Binding Mechanism," and filed on Oct. 29, 2012, which claims priority to U.S. provisional patent application No. 61/552,239, entitled "Connected Disk Binding Mechanism" and filed on Oct. 27, 2011, which are hereby incorporated by reference herein in their entireties.

TECHNICAL FIELD

The present subject matter relates generally to binding systems, and more particularly to a connected disk ring binding mechanism.

BACKGROUND

Binding systems are used in connection with binders, folders, books, notebooks, and the like. A binding system functions to maintain two or more sheets, which may be paper, paper-like sheets, or sheets of any other material, in a bound association with one another. A binding system may also function to maintain such sheets in a bound association one or more cover members, the cover members being optionally bound to the binding system.

Various forms of binding systems are known in the art. For example, typical a spiral binding system includes a thin, coiled, binding wire with coils that pass through holes at an edge of the sheets. A typical ring binding system includes one or more rings or ring-like members, optionally connected to one another by a spine member, that pass through the holes in the sheet edges. An adhesive binding system includes a spine member with an adhesive thereon for adhesively binding the sheets along an edge thereof Other binding systems are known by those having ordinary skill in the art.

A subset of ringed binding systems are disk ring binding systems. In one example thereof, U.S. Pat. No. 5,015,114 discloses a binder ring having a disk shaped central portion, an aperture formed substantially in the center of the central portion, and an annular outer rim formed on the periphery of the central portion. The outer rim includes an arcuately shaped, outer surface configured as an outer segment of a circle, and has an axial width greater than the axial width of a central portion. The paper sheets have die cut perforations on one edge sized to fit about the outer rim of the binder rings. U.S. Pat. No. 5,553,959 discloses a disk ring binding system in which a stack of sheets is bound together using a plurality of disk fastening members insertable into openings of the stack of sheets to retain the sheets in the stack. The disk members have a substantially flat disk-like central surface portion and an enlarged continuous rim portion which extends around the periphery of the central surface portion of the disks. The rim portion extends outwardly in a direction perpendicular to the flat central portions of the disks, and the central surface portion has a radius which is larger than the thickness of a stack of sheets to be bound thereby. U.S. Pat. No. 6,074,152 discloses a binding system for index-books and notebooks, with mutually aligned disks having a double-T cross-section. The edge portion of the sheets receives the disks inserted in seats formed in the sheets. Further examples of disk ring binding systems are disclosed in U.S. Pat. Nos. 6,350,096, 6,364,560, and PCT Patent Application Publication No. WO 2007/060185.

It would be desirable to provide an improved disk ring binding system over those systems known in the art.

SUMMARY

In one embodiment, the binding member has a first disk ring portion configured for reception in a binding recess of a sheet member. The first disk ring portion can have an inner surface that faces radially inward for engaging and retaining a first binding protrusion of a sheet member for binding the sheet member. The first disk ring portion can be configured for allowing the bound sheet members to slide around the first disk ring portion while retaining the engagement. The binding member can also have an axial extension member associated with the first disk ring portion and extending generally in an axial direction with respect thereto.

The binding member can also include a second disk ring portion connected to the axial extension on an opposite side thereof from the first ring portion. The second disk ring portion can be configured for reception in a binding recess of a sheet member. The second disk ring portion can have an inner surface that faces radially inward for engaging and retaining a second binding protrusion of a sheet member for binding the sheet member. The second disk ring portion can be configured for allowing the bound sheet members to slide around the second disk ring portion while retaining the engagement. The first and second ring portions can be associated for cooperatively maintaining the first and second binding protrusions engaged thereto.

The axial extension can have a smaller diameter than a diameter of the first and second disk ring portions to define a channel therebetween. The depth of the channel can be between about ¼ and ½ the diameter of the first and second disk ring portions.

In one embodiment, the first and second disk ring portions can also have a rim that can include the inner surface for engaging and retaining first and second binding protrusions, respectively. The axial extension member is disposed coaxially with the rim.

The first and second disk ring portions can also have a recessed area disposed radially inward of the rim, the rim extending radially and axially outward beyond the recessed area.

In another embodiment, the axial extension member can have an axial width, the first ring portion has a diameter, and the ratio of the axial width to the diameter is greater than about 3/4.

In an embodiment of a booklet, the booklet can have a plurality of binding members that align coaxially to form a booklet hinge and a plurality of sheet members that can define a sheet binding portion for receiving and engaging to the binding members such that the sheet members is slidable around the binding members to move the sheet members around the booklet hinge. The sheet binding portions can define binding recesses for receiving the binding members, such that the sheet member can be flipped around the binding members to turn the sheet member. Further, the sheet members can comprise first and second covers and a stack of pages therebetween receiving the binding members in the recesses, such that the sheet member can be flipped around the binding members to turn the covers and pages. In one configuration the booklet can be a notebook.

In another embodiment, the sheet member can be an expandable sheet member that has a first sheet member having a binding edge and a second sheet member having a bindable edge opposite the binding edge. The first and second sheet member can be hinged to each other at the intra-sheet hinge disposed between the binding edge and bindable edge. The expandable sheet member can also include a sheet binding portion defining binding recesses that can be disposed on the binding edge and bindable edge configured for engaging the binding members. The bindable edge can have fewer binding recesses than the binding edge for easier engagement and disengagement of the bindable edge to the binding members coaxially aligned to form the booklet hinge.

The second sheet member can be moveable between a folded position and an unfolded position. In the folded position, the second sheet member can be folded over the first sheet member at the intra-sheet hinge such that the bindable edge of the second sheet member is aligned with the binding edge of the first sheet member. In the unfolded position, the bindable edge of the second sheet member can extend away from the binding edge of the first sheet member.

The binding recesses can be disposed along the bindable edge of the second sheet member to engage the binding members in the folded position. In one embodiment, the binding recesses of the bindable edge can engage to the same binding member as a binding recesses of the binding edge when in the folded position. The sheet member can be a cover member.

In one embodiment of the booklet, the booklet can have a gripping member disposed along the bindable edge configured to facilitate disengaging the second sheet member from the binding members.

In one embodiment of an expandable sheet member, the expandable sheet material can include a first sheet member having a binding edge and a second sheet member having a bindable edge opposite the binding edge. The first and second sheet member can be hinged to each other at the intra-sheet hinge, the intra-sheet hinge being between the binding edge and bindable edge. The expandable sheet material can also include a binding mechanism and a sheet binding portion that can define binding recesses being disposed on the binding edge and bindable edge configured for receiving and engaging with the binding mechanism.

BRIEF DESCRIPTION OF DRAWINGS

The drawing figures depict one or more implementations in accord with the present concepts, by way of example only, not by way of limitations. In the figures, like reference numerals refer to the same or similar elements.

DETAILED DESCRIPTION

Figure 1:
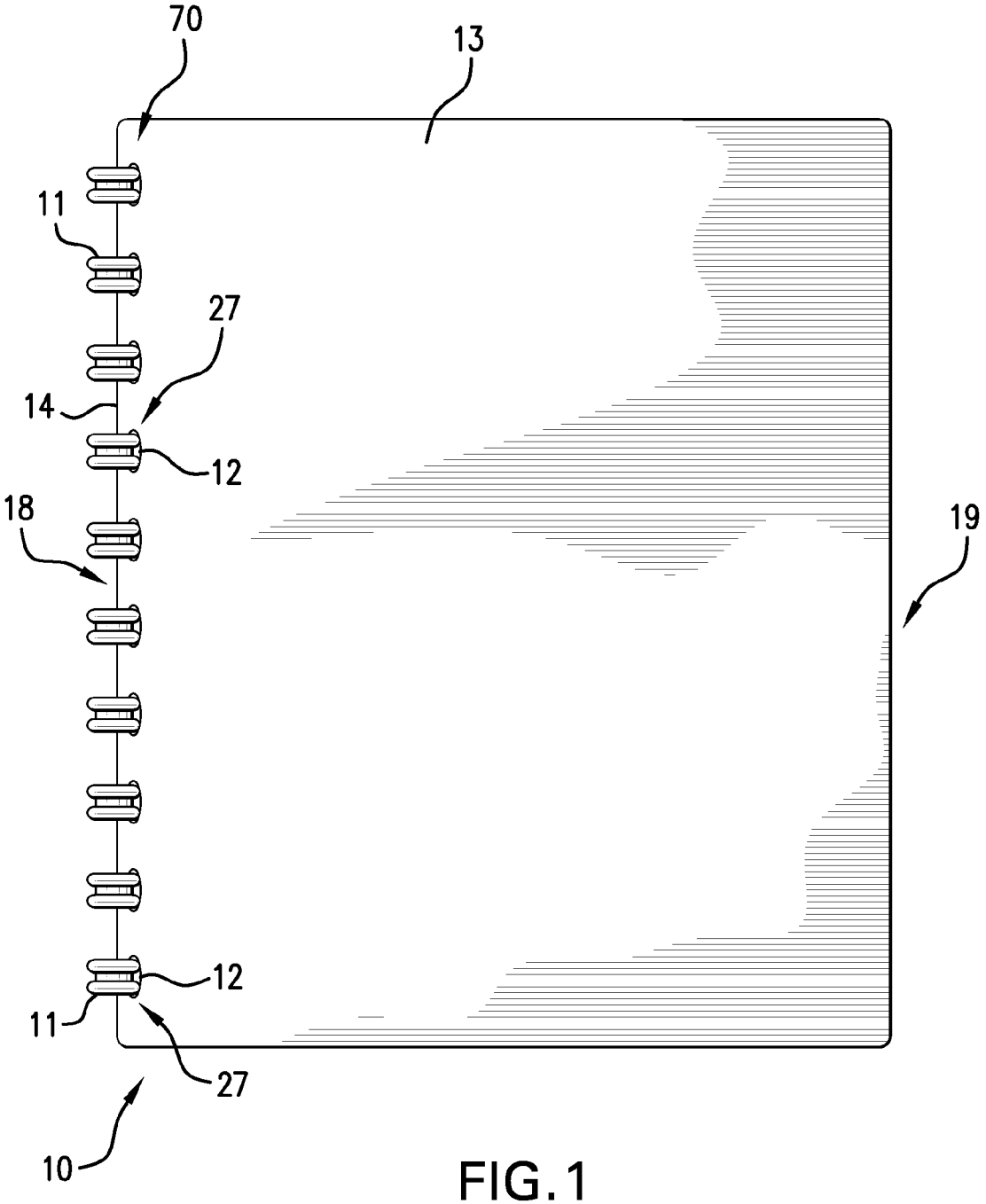
FIG. 1 is a front view of an embodiment of a disk ring binding mechanism employed on a notebook.
Figure 2:
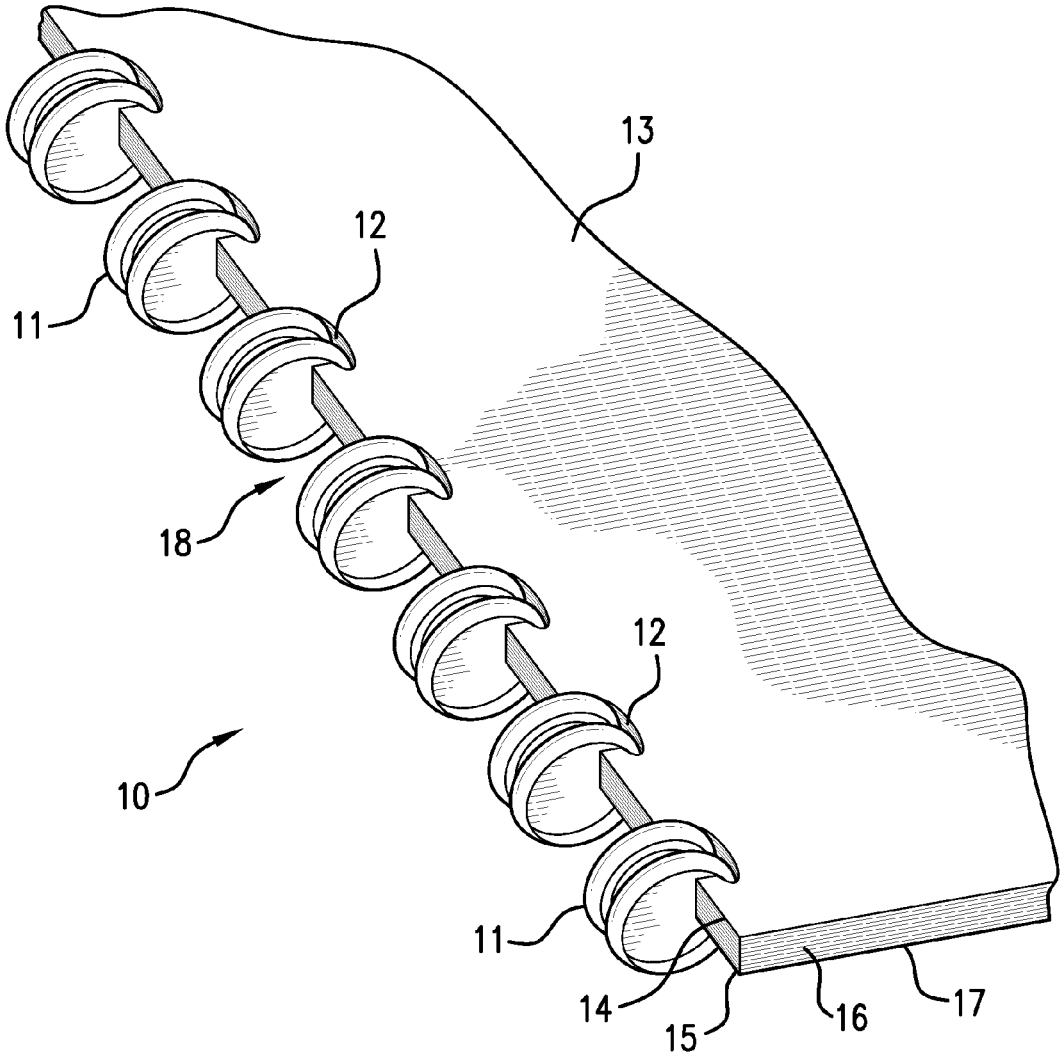
FIG. 2 is a perspective view thereof.

Referring to FIGS. 1 and 2, a notebook 10 is provided with a binding mechanism 18, such as a ring binder mechanism, that preferably includes a plurality of a disk ring binding members 11. The notebook 10 generally includes bounded elements including sheet members 15, such as a first cover member 13, a second cover member 17, and a plurality of sheets 16 disposed therebetween.

A notebook 10 is disclosed herein in connection with the binding mechanism 18 for ease of description. The connected disk binding system disclosed herein, however, can alternatively be used for other types of books, booklets, or pamphlets or the like, such as pre-printed reports, pre-printed books, graph paper books, notebooks and/or printed books with dividers, and the like. As such, which a notebook 10 is described, the presently described binding system can be employed in connection with any or all of such other forms where paper or other sheets are bound together and/or enclosed by one or more cover members.

A notebook 10 may generally be of any size or shape. For example, a notebook 10 may be configured to hold standard 8.5 by 11 inch sheets of paper, in a rectangular shape. Alternatively, notebook 10 may be square, circular, oval, polygonal, regular, irregular, etc., and can hold other standard and non-standard paper sizes. It typically ranges in size from less than one square inch to greater than 1000 square inches, and more typically 50 square inches to 150 square inches.

Generally, the binding mechanism 18 includes a binding member 11 having a disk ring portion configured for reception in a sheet binding portion 70. The sheet binding portion 70 includes binding features, such as receiving portions 27, of a sheet member 15, that are disposed along the binding edge 14 of the sheet members 15. The disk ring portion 21 has an inner surface 20 that faces radially inward, providing a circumferential ridge for engaging for retaining a binding protrusion 29 of a sheet member 15 therein for binding the sheet member 15, wherein the ring portion 21 is configured for allowing the bound sheet members 15 to slide around the ring portion 21 while retaining the engagement; and an axial extension member associated with the ring portion and extending generally in an axial direction with respect thereto. Certain embodiments of such binding member 11 will be discussed below.

The notebook 10 disclosed in FIG. 1 includes ten disk ring binding members 11 forming the connected disk ring binder system. It will be appreciated, however, that in various embodiments, more or fewer members 11 may be used. For example, one, two, three, four, five, six, seven, eight, nine, ten, eleven, twelve or more connected disk ring binding members 11 may be used. Preferably, the notebook 10 has eight to twenty disk members. Preferably, the number of binding features of the sheet binding portion 70 is between 20% to 70% the number of binding members 11. More preferably, the number of binding features is equal to the number of disk ring binding members 11.

The sheets 16 can generally be made of any suitable material or combination of materials. In some embodiments, the sheets 16 may be made of a thermoplastic material, such as PP or PE. In some embodiments, the sheets 16 may be made of a fiber-based material, such as various forms of paper. Zero, one or more sheets 16 may be used, for example, 50 sheets, 100 sheets, 500 sheets, or more. The disk ring binding members 11 may be sized to accommodate more or fewer sheets 16.

The cover members 13, 17 can generally be made of any suitable material or combination of materials, although the cover material is typically more robust and often stiffer than the sheets 16. In some embodiments, the cover members 13, 17 may be made of a thermoplastic material, such as PP or PE. In some embodiments, the cover members 13, 17 may be made of,a fiber-based material, such as various forms of paper. Cover members 13, 17 can be laminated to add strength, such as when made of paper or other fiber-based material. Typically, one, or two covers are used, although covers with pivoted panels, and sometimes additional covers are used, such as in embodiments with more than one hinge, each formed of a line of disk ring binding members 11 or another type of hinge. Some embodiments employ dividers of similar configuration to the covers, but placed within the bound stack of sheets. The sheets 16 are typically disposed between the cover members 13, 17, as shown in FIGS. 1 and 2. Alternatively, sheets 16 may be disposed on any side of a single cover member, or interspersed variously between two or more cover members, depending on how the notebook 10 is assembled or how the covers 13, 17 are flipped.

The binding mechanism 18 is disposed proximate and along the binding edge 14. The binding mechanism 18 can include disk ring binding members 11 that are disposed proximate and along the binding edge 14 of the sheet members 15.

Figure 3A:
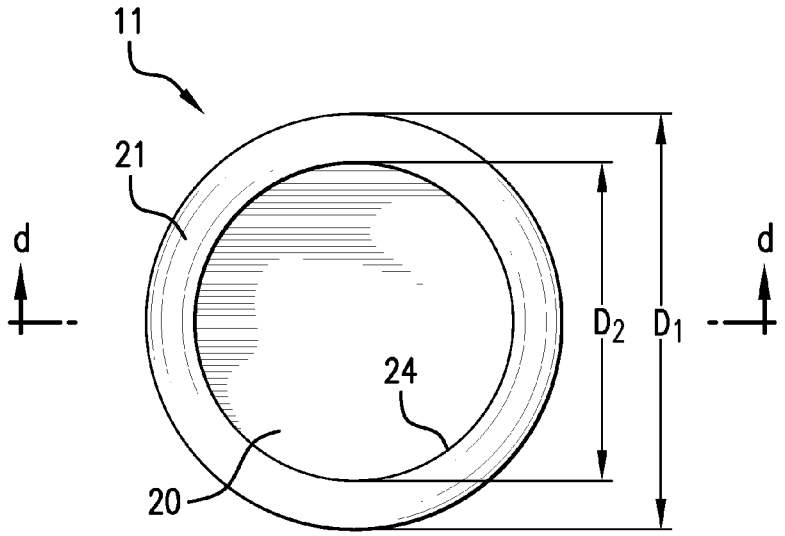
FIGS. 3*a-c* are side, perspective, and front views, respectively, of a disk ring member in accordance with the embodiment of FIG. 1.
Figure 3B:
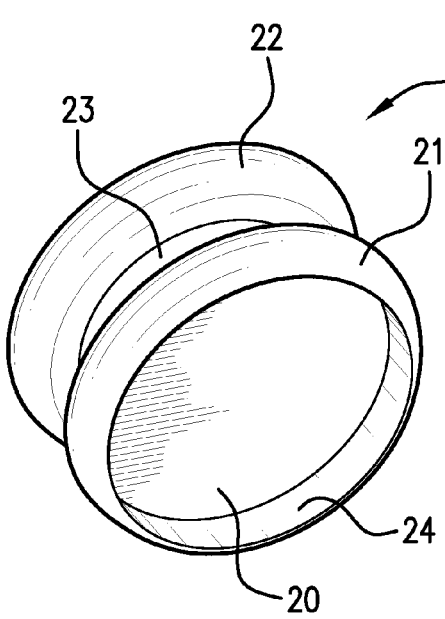
Figure 3C:
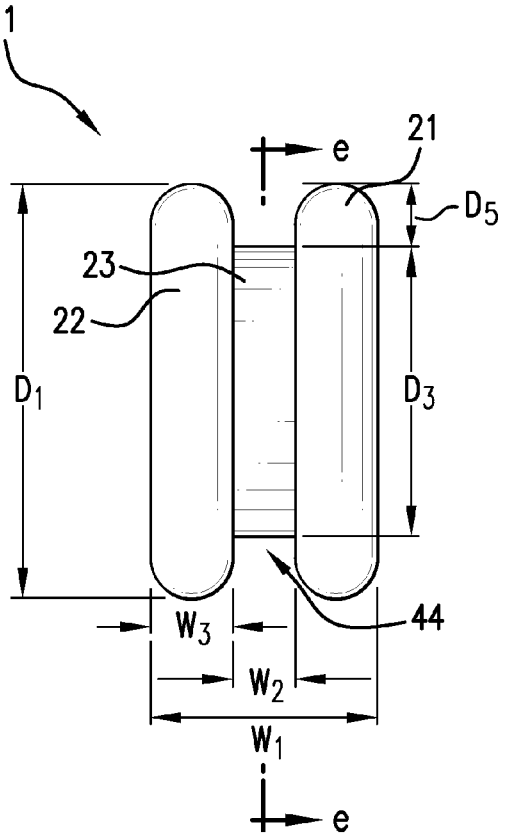
Figure 3D:
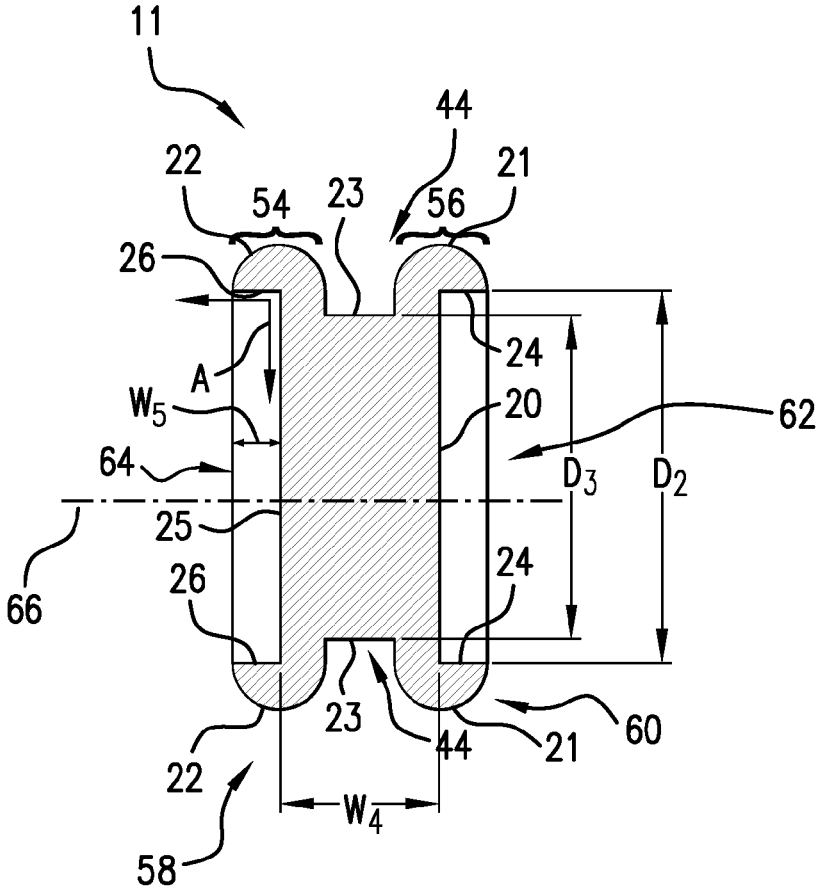
FIGS. 3*d* and 3*e* are a front and side cross-sectional views thereof.
Figure 3E:
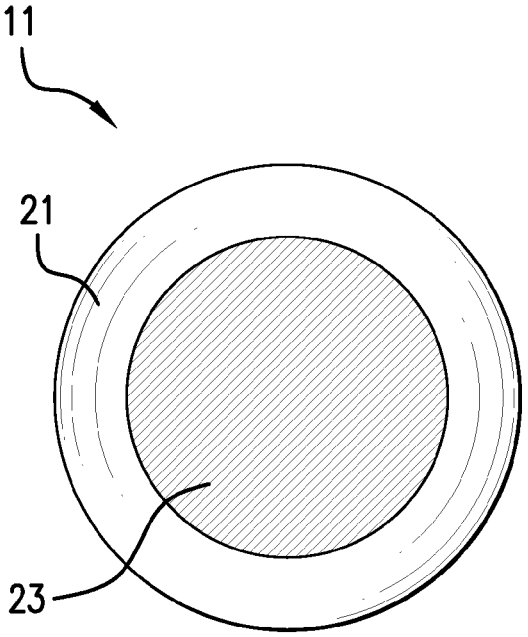

One embodiment of a disk ring binding member 11 is shown in FIGS. 3*a*-3*e*. FIG. 3*a* shows a side view thereof. FIG. 3*b* is a perspective view thereof. FIG. 3*c* is a front view thereof. FIG. 3*d* is a cutaway view of thereof taken along line d-d as shown in FIG. 3*a*. FIG. 3*e* is a cutaway view of the connected disk ring member, taken along line e-e as shown in FIG. 3*c,f*

As shown in FIGS. 3*a* through 3*e,* the disk ring binding member 11 includes a first disk ring portion 21 and an axial member that extends generally in an axial direction with respect to the first disk ring portion 21. In this embodiment, the axial member can be connected to a second disk ring portion 22 to form a connection portion 23.

The disk ring portions 21, 22 are generally circular as viewed axially (see FIG. 3*a*). The outer perimeter of each disk ring portion 21, 21 can be curved, or in some configurations can be substantially flat when viewed radially, or can have other suitable shapes. The disk ring portions 21, 22 can include a recessed area 62, 64, respectively, that is disposed radially and axially inward of a rim 58, 60. Thus, the rim 58, 60 extends radially and axially outwardly beyond the recessed area. The rim 58, 60 can be generally ring-shaped, or can have other suitable shapes. The outer edges 54, 56 of each of the rim 58, 60 can define the outer perimeter of the disk ring portions 21, 22. Each of the rims 58, 60 further includes a rim 24, 26 that face radially inwardly. Each of the rim inner surfaces 24, 26 preferably has a generally hollow, cylindrical configuration, providing a ring to allow smooth flipping of the sheet members 15 therearound. The rim inner surfaces 24, 26 can be generally flat in axial cross-section, or they may have a curvature, or other suitable shape to engage the protrusions 29, 30 of the receiving portions 27.

Each of recessed area 62, 64 can be bounded by the axial surfaces 20, 25 and rim inner surfaces 24, 26, respectively. The rim inner surfaces 24, 26 can extend axially from the axial surfaces 24, 25 respectively to form the perimeter of the recessed area. Each axial surface 20, 25 can have a generally circular disk shape. Alternatively, the axial surfaces 20, 25 can have a flat surface, or in other configurations can be curved or other suitable shape. Connected to and disposed adjacent to each axial surface 20, 25 can be the respective rim inner surface 24, 26. The connection therebetween may define generally a right angle. Angle "A", as shown in FIG. 3*d*, generally illustrates this relationship between the axial surface 25 and the ring portion 26. In alternative embodiments angle "A" can be any other suitable angle, such as forty-five degrees, or shape. Additionally, the recessed area 62, 64 and/or the rim 58, 60 can have a depth W5 that is sufficient to retain and engage the receiving portion 27 of the sheet materials.

The disk ring portions 21, 22 have a diameter D1 at their outer radial perimeter. In this embodiment, for example, the rim inner surfaces 24, 26 have a diameter D2 at which it engages the protrusions 29, 30 of the sheet members 15. The rim inner surfaces 24, 26 are parallel to the axis 66 of the binding member so that the rim 58, 60 at its inner surface has a diameter D2. The recessed area 62, 64, being bounded by the rim inner surfaces 24, 26, also has a diameter D2 in this embodiment. The ratio of diameters D2 to D1 can be, for example around or under 98% to preferably at least about 50%. In a preferred embodiment, said ratio is between about 75% and 95%.

While the preferred embodiment described has rims 58, 60 that extend axially outwardly, having rim inner surfaces 24, 25 and recessed areas 62, 64 that receive and trap the protrusions 29, 30 of the sheet members 15 from a axially outside the binding member 11, an alternative embodiment can have the rims 58, 60 extending axially inwardly to receive and capture the sheet member protrusions 29, 30 from an axially interior side of the rims 58, 60. Thus, other configurations of the binding features of the sheet members 15 can be employed, binding the sheet members 15 while allowing them to be turned about the binding mechanism 18.

The connection portion 23 shown has a generally cylindrical in shape, or other suitable shape. The connection portion 23 can define a generally pinched inward area, groove, or channel 44 around the connection portion 23 and between the two disk ring portions 21, 22. In one embodiment, the channel 44 can be ring-shaped.

The channel 44 provides profile of disk ring binding members 11 that can be beneficial, for example, to aid in holding the binding members 11 and manipulation of the members 11 during removal and insertion of sheets or of the member 11 into the covers or covers assembled with the sheets. The channel 44 can provide improved tactile gripping area for the fingers, allowing the finger pads or other fleshy part of the finger to enter the channel 44 to help gain purchase over the member 11 and prevent slippage while holding the member 11 between the fingers. Additionally, the connection portion 23 or channel 44 can be beneficial during manufacturing of the binding member 11. For example, in situations where the binding member 11 is created through injection molding, there is decreased chance of deformities during the cooling process because the thickness of the connection portion 23 is reduced or maintained more consistent. The channel 44 has a depth D5 as shown in FIG. 3*c*. Preferably, the depth D5 of the channel 44 is 10% to 30% of the radius of the disk ring portions.

The connection portion 23 shown has an axial width W2 between the two ring disk portions 21, 22 (FIG. 3*c*) and a diameter D3 (FIGS. 3*c*, 3*d*). As shown in FIG. 3*d*, the diameter of the recessed area D2 is generally larger than the diameter D3 of the connection portion 23. Alternatively, diameter D3 may be large or smaller than diameter D2.

The connection portion 23 preferably has a smaller diameter D3 than the diameter D1 of the disk ring portions 21, 22. The ratio of diameters D3 to D1 is typically, for example, about 1/2 to about 4/5. Preferably, such ratio is between about 3/5 to about 4/5. In this respect, the disk ring binding member 11 in one embodiment can have a dumbbell configuration, pinched in the middle at the smaller diameter connection portion 23 between the larger diameter disk ring portions 21, 22. For example, the binding member 11 can have two large diameter disk ring portions 21, 22 at either end of a narrower diameter connection portion 23.

While the connection portion 23 of the embodiment shown has a constant axial diameter, alternative embodiments can have connection portions of varying diameters, such the shape of one or two cones tapering towards the center of towards one of the ring portions 21, providing the recessed channel around the periphery of the binding members.

The disk ring portions 21, 22, when viewed from the front (see FIG. 3*c*) may have a width that is defined by W3. The combined width W3 of both disk ring portions 21, 22 and the width W2 of the connection portion 23 therebetween may define a width of the connected disk ring binding member 11 of W1.

The ratio of the width of the binding member 11 W1 to the diameter of the binding member 11 D1 may generally be greater than about 1/3, greater than about 2/5, greater than about 1/2, greater than about 3/4, or greater than about 1. In a preferred embodiment, the ratio may be between about 0.5 and 0.7. The relatively high width to diameter ratio, or aspect ratio, of the presently described connected disk ring binding members 11 yield several beneficial results compared to traditional disk ring binders in which the width to diameter ratios are much smaller. This elevated width to diameter ratio can allow the binding members 11 may be more easy to manipulate by hand, for example, when adding or removing sheets from the notebook 11. Additionally, when two sheets 16 or the covers 13, 17 are slidable with respect to the hinge axis 68, tending to shear the disk binding members therebetween, the higher aspect ratio tends to limit the pivoting of the disk binding members between the moving sheets and covers. This maintained alignment preserves the ease of flipping sheets around the disk binding members 11, such pages of a notebook are turned, reducing tears or other damage to the sheets and covers. As further shown in FIG. 5*b*, a hinge axis 68 is generally coaxial with the binding member axis 66 defining a hinge, such as a booklet hinge, of the binding mechanism 18.

Receiving portions 27 include a recess 12, which is preferably cut away from the sheet material of the covers 13, 17 and sheets 16, and is configured and dimensioned for receiving and retaining the disk ring binding member 11 while allowing the disk binding member 11 to rotate therein, or the cover or sheet to rotate around the member 11. As shown in FIG. 2, the receiving portions 27 are disposed proximate and along the binding edge 14 of sheet members 15. Binding recess 12 includes a disk ring retaining area 12*a* and a disk ring sliding area 12*b*. The disk ring retaining area 12*a*, in the embodiment shown, is of a generally oval shape, in some embodiments other suitable shapes can also be used, and it is bounded by opposite end portions 28*a*, 28*c* of the interior edge the sheet member 15. Opposite end portions 28*a*, 28*c* have a relatively smaller radius of curvature than back portion 28*b*, although other shapes, including with straight sides and sharper angles, can be used. The side of the retaining area 12*a* opposite the back side of the retaining area 12*a* is open to the sliding area 12*b*. The side of the sliding area 12*b* opposite from the retaining area 12*a* is open to the exterior of the binding recess to receive the binding member 11. The sliding area 12*b* is defined by binding protrusions 29, 30. In one embodiment, the binding protrusions 29, 30 can be parallel to one another. The protrusions 29, 30 in this embodiment can extend toward each other and axially inward, or in other embodiment axially outward, to pinch the recessed area 62, 64 such that the sliding area 12*b* is narrower than the retaining area 12*a* to catch on the rims 58, 60 on the opposite side of the binding member.

The ratio of the depth L2 (e.g., from the back side 28*b* of the sliding area 12*a* to the ends 29*a*, 30*a* of the protrusions 29, 30) and width L1 (between opposite axial sides 28*a*, 28*c*) of the retaining area 12*a*) of the sliding area is typically about 1/4 to 3/4. Preferably, the ratio is between about 1/4 to 1/2, and sometimes between about 1/4 and 1/3. In one embodiment, width L1 is two or three times larger than depth L2. This high-width ratio can provide for greater stability without requiring an increased width W2 of the connection portion 23. In general, the ratio of the width L3 of the sliding area 12*b* to width L1 is typically about 1/3 to 3/4. Preferably, the ratio is between about 2/5 and 3/5.

The axial width W4 between the two recessed areas 62, 64 (e.g., through the binding member 11 between the axial surfaces 20, 25, as shown in FIG. 3*d*. In one embodiment, width L3 is the same as or very close to width W4 of the binding member, as shown in FIG. 3*d*, for snug association between the disk portions 20, 25 if the binding member 11 and the protrusions 29, 30 of the sliding area 12*a*. Preferably, however, width L3 of the binding recess 12 is slightly larger than width W4, but smaller than width W1, to reduce friction during flipping of the sheet members around the rims 58, 60. In use, the user will slide the binding member 11 through the sliding area 12*b* of the receiving portion 27. The protrusions 29, 30 are sufficiently flexible to resiliently deform to accommodate entry or removal into and out of the recessed area 62, 64, for example by bending or deflection of the protrusions 29, 30. The axial length of the protrusions 29, 30 is also sufficient to retain engagement of the sheet material 15 on the binding member 11, but not inhibit sliding of the sheet material around the binding member 11.

Figure 4A:
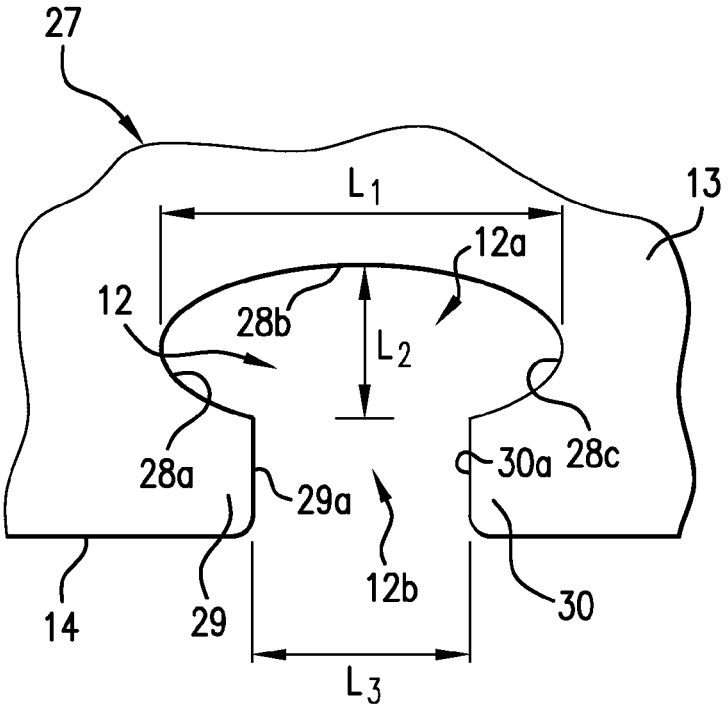
FIG. 4*a* shows the connected disk ring member receiving portion of the embodiment of FIG. 1.
Figure 4B:
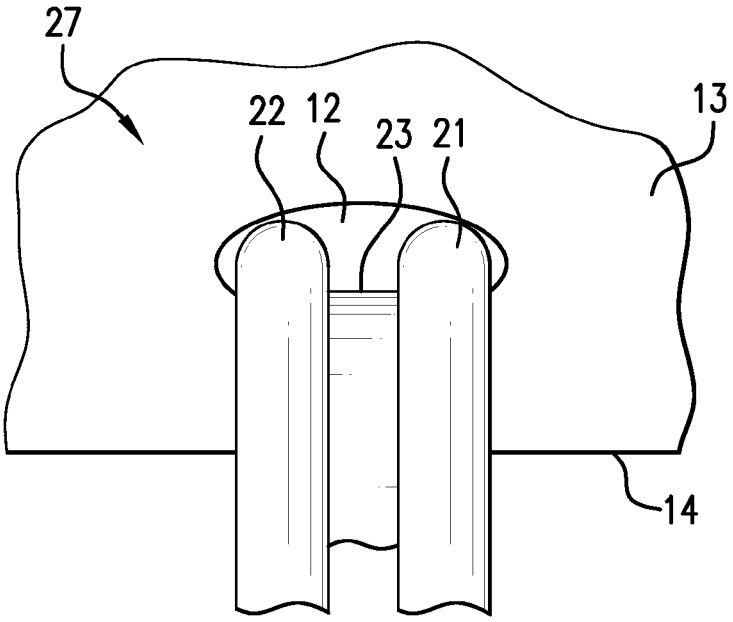
FIG. 4*b* shows a connected disk ring member received within the receiving portion of FIG. 4*a*.

As shown in FIG. 4*b*, the protrusions 29, 30 are received in the recessed area 62, 64 and the binding member 11 is received in the recess 12 and the protrusions 29, 30 are held by the rims 58, 60 to allow the sheet members 15 to be flipped or slide all around the rim 58, 60. For example, the protrusions 29, 30 can engage radially with rim inner surfaces 24, 26 to retain the sheet material.

The length L1 may be slightly greater than the width W1, thus accommodating the full width of the member 11 within the retaining area 12*a* of the receiving portion 27. However, because L3 is smaller than W1, the protrusions 29, 30 of the sliding area are disposed within the perimeter of the ring portions 24, 26, and generally abut the flat surface of the disk portions 20, 25. In this manner, the binding member 11 is retained within the receiving portion, the ring portions 24, 26 thereof being retained within the retaining area 12*a* (prevented from sliding back out through the sliding area 12*b* because length L3 is smaller than width W1).

The relatively low L2:L1 ratio of the presently described receiving portion 27 yields several beneficial where such ratio is much larger (as in the case of a circular area, for example, where there ratio would be about 1). In one aspect, the sheets 16 may be more securely connected to the binding members 11. The low ratio effectively prevents the binding members from deflecting in either direction with respect to their central axis, thus resulting in a smaller chance of the member being inadvertently dislodged. In another aspect, the binding members 11 may allow the sheets 16 to move more easily while connected to the binding members 11, such pages of a notebook are turned. The wide profile of the receiving portion allows the binding member 11 to stay more stable (move less) when pages are turned, thus resulting in smoother page turning and less chance of jamming.

Figure 5A:
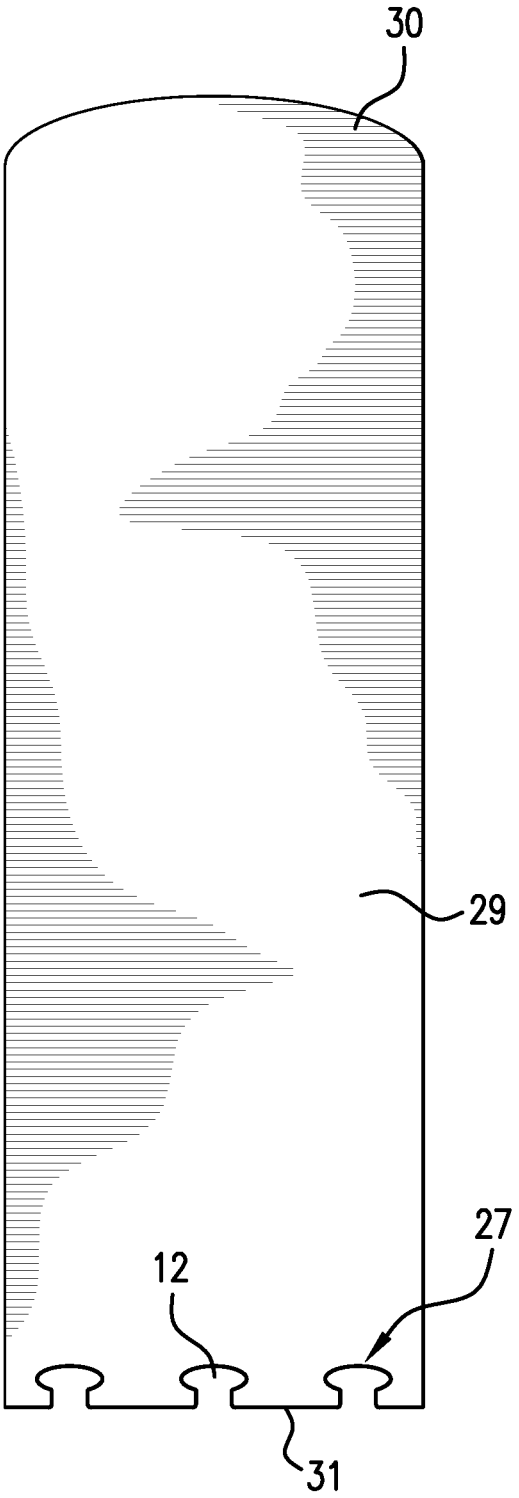
FIG. 5*a* shows a dividing member in accordance with one embodiment.

A notebook 10 in accordance with the present disclosure may be provided with one, two, three, four, or more dividing members 50. An example dividing member 50 is shown in FIG. 5*a*. The dividing member 50 can generally be made of any suitable material. In some embodiments, the sheets may be made of a thermoplastic material, such as PP or PE. In some embodiments, the sheets may be made of a fiber-based material, such as various forms of paper. Dividing member 50 may include receiving portions 27, as discussed above, for receiving connected disk ring binding members 11. In this manner, dividing members 50 may be inserted within the notebook 10 between sheets 16, for example, to divide the plurality of sheets 16 into sections, as may be useful for organizing purposes.

In some embodiments, sheets 16 may be made of a relatively flexible material, and/or covers 13, 17 may be made of a relatively flexible material, so as to allow relatively facile yet secure insertion of the binding members 11 into the receiving portions 27. Alternative embodiments can have other members that attach to one or a plurality of the binding members, such as sheets or other supports for releasable stickers.

Figure 5B:
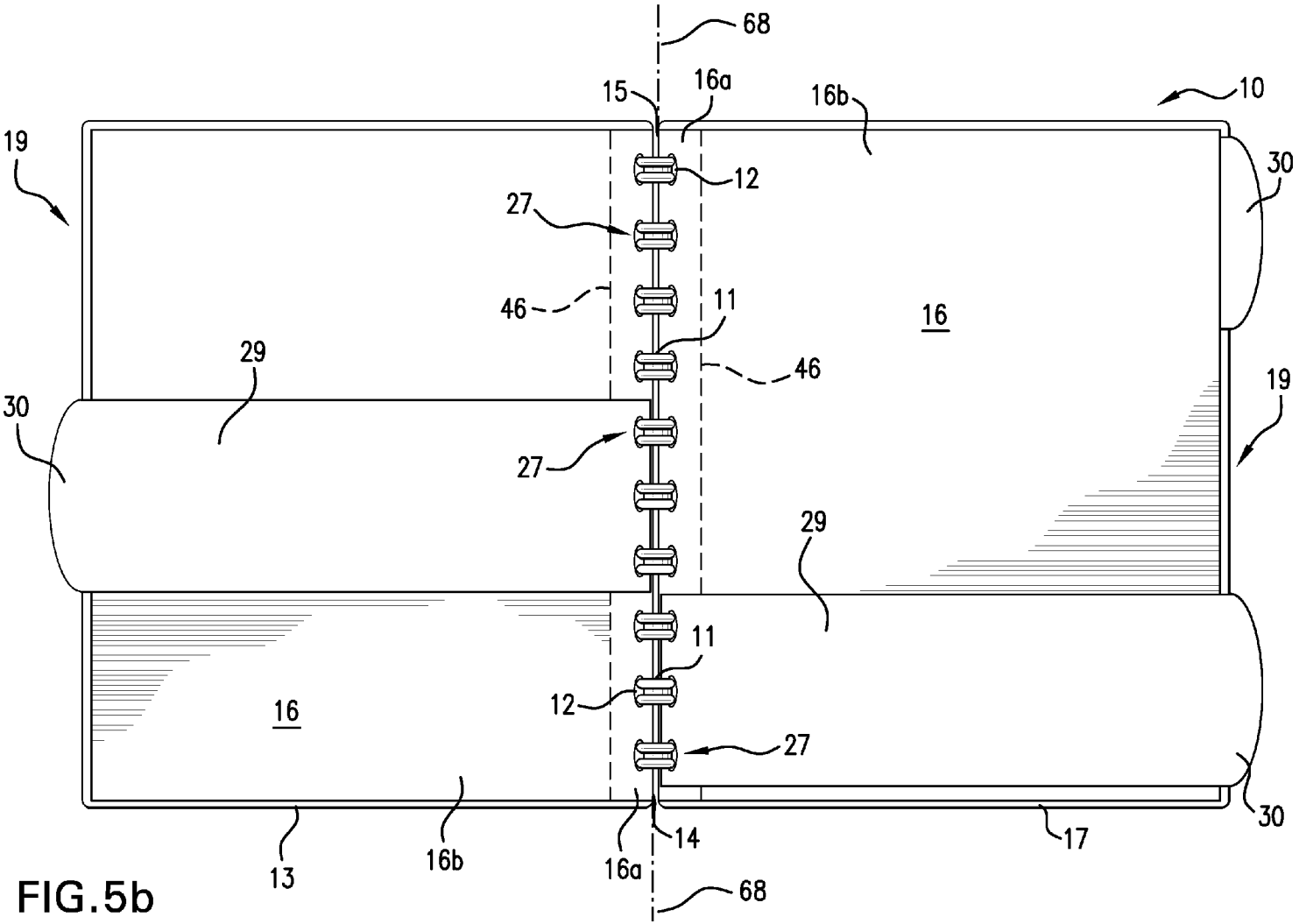
FIG. 5*b* shows the dividing member of FIG. 5*a* employed in the notebook of FIG. 1.

FIG. 5*b* shows three dividing members 50 connected to the members 11 of the connected disk ring binding system. Such dividing members 50 are sized such that an extending portion 52 extends beyond the side edge 19 of the notebook 10. The extending portion allows for easy reference in finding a particular sheet 16, or section of sheets 16. Extending portion 52 may extend ¼ inches, ½ inches, ¾ inches, 1 inch, 2 inches, or more beyond the side edge 19. In a preferred embodiment, the extending portion 52 extends between about ¼ inches and ¾ inches beyond the side edge 19. The dividing portions 50 may be of different colors with respect to the sheets 16, with respect to the cover members 13, 17, and/or with respect to each other, for ease and variety of use. The dividing portions 50 may be connected by at least 1, at least 2, at least 3, or at least 4 members 11 in alternative embodiments. The dividing portions may be connected by 10% to 50% of the members 11, or 20% to 40% of the members 11 in alternative embodiments. Any number of dividers may be provided. The width of the dividers may be ⅕ to ½ of the width of the sheets, such that there may be 1, 2, 3, 4, 5 or more dividers provided between any given sheets. As shown, they are about ⅓ of the width, allowing for three dividers between any given sheets.

As further shown in FIG. 51, in one embodiment, the sheets 16 can include one or more lines of weakness 46, which may be perforations, disposed inwardly from and parallel to the binding edge 18. Such lines of weakness 46 may facilitate separation of sheets 16 from the notebook 10, as is known in the art. In one embodiment, lines of weakness 46 may be disposed inwardly from the receiving portions 27 of the sheets 16, thus leaving a sheet strip 16*a* bound to the binding members 11 when removal portion of the sheet 16*b* is removed along the line of weakness 46.

In another embodiment of the notebook 10, the sheet members 15 can be associated with a binding mechanism 18 and can be expandable such that the sheet member 15 includes expandable portions connected at a hinge 33 that are moveable between a folded and unfolded position. In the folded position, the expanded portions of the sheet member 15, in some configurations, can engage with the binding mechanism 18. The hinge 33 preferably is disposed to bi-sect the sheet member 15 into two generally equal portions. Alternatively, the hinge 33 can be disposed in other locations on the sheet member 15 to split the sheet member 15 into different sized portions. In other embodiments, multiple hinges 33 can be used to achieve the result of an expanded sheet member 15.

Figure 6A:
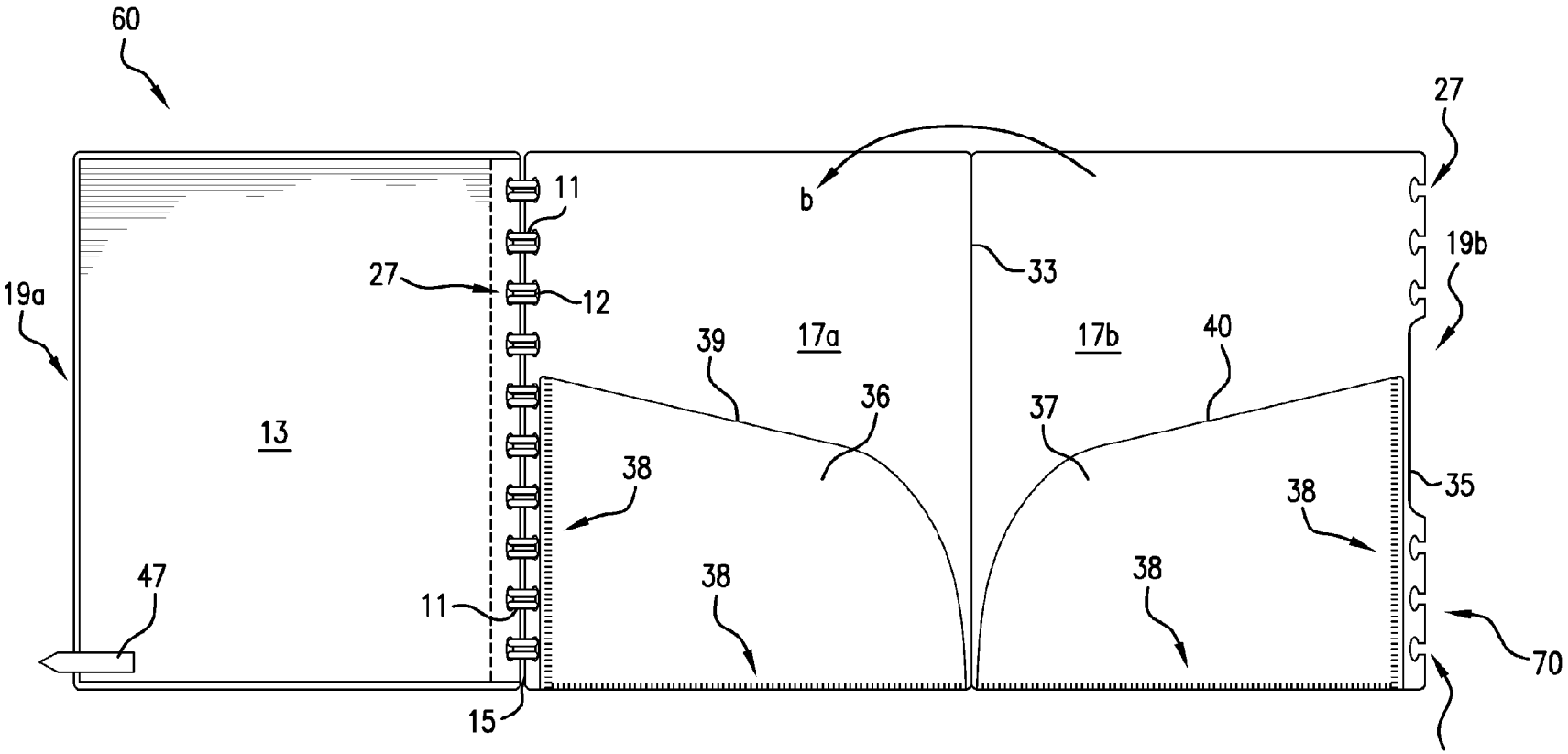
FIG. 6*a* shows an alternative embodiment of a notebook employing a multiple panel cover in an unfolded configuration.
Figure 6B:
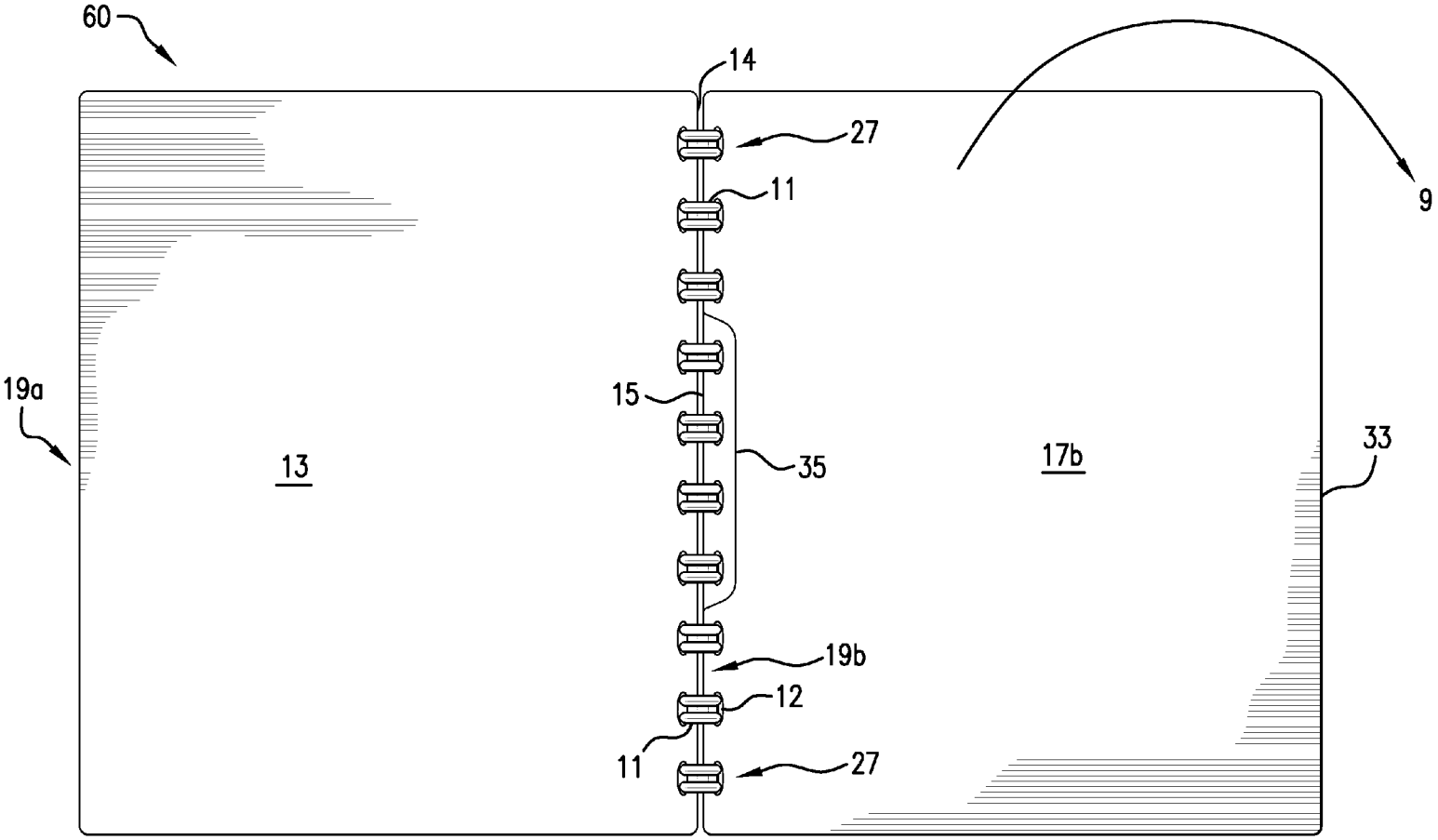
FIG. 6*b* shows the notebook of FIG. 6*a* in a folded configuration.

FIGS. 6*a* and 6*b* discloses an exemplary expandable sheet member 15, such as an expandable cover member 17. The cover member 17 has an outer expandable portion 17*a* and an inner expandable portion 17*b*, connected to one another along a intra-sheet hinge 33, such as a fold, live hinge, or a score line, other types of hinges can also be employed. The hinge 33 may in the alternative be a set of disk ring binding members associating the cover portions in a hinged connection.

The outer expandable portion 17*a* and inner expandable portion 17*b* can be generally similar in size and shape. In other configurations, the outer expandable portion 17*a* can have different sizes or shapes than the inner expandable portion 17*b*. As shown in FIG. 6*a*, the inside surface of expandable portions 17*a* and 17*b* can include one or more pockets 36, 37 affixed thereto. Affixing means 38 can be disposed along the edges of the pockets 36, 37, along edge portions thereof, to affix said pockets 36, 37 to the cover portions 17*a*, 17*b*, respectively. Affixing means 38 may include, for example, thermal welding, sonic welding, adhesives, and the like. Edge portions 39, 40 of the pockets 36, 37, respectively, may remain free from the cover portions 17*a*, 17*b*, to allow receipt of an item or items (for example, sheets) therewithin.

The expanded sheet member 15 disclosed in FIGS. 6*a* and 6*b* is associated with a binding mechanism 18. The cover portion 17 includes a binding edge 14 disposed proximate and along the inside expandable portion 17*a*, and a bindable edge 19 disposed along the outer expandable portion 17*b* parallel to the binding edge 14 and opposite the hinge 33. The hinge 33 is oriented in relation to the inner and outer expandable portions 17*a*, 17*b* so that when in the folded position the binding edge 14 and bindable edges 19*b* are aligned with each other, preferably overlapping to engage the binding mechanism 18. Sheet binding portions 70 are disposed along the binding edge 14 and bindable edge 19*b* to engage with the binding mechanism 18. The sheet binding portions 70 can be disposed continuously along the binding edge 14.

Preferably, the bindable edge 19*b* and binding edge 14 has a sheet binding portion 70, such as receiving portions 27, disposed continuously along the binding edge 14 and/or bindable edge 19*b*. In other configurations, the bindable edge 19*b* and binding edge 14 can be disposed discontinuously along the bindable edge 19*b* and/or binding edge 14. The receiving portions 27 along the bindable edge 19*b* can have a discontinuous portion to define a gripping portion 35. The gripping portion 35 is configured for not engaging with the binding members 11 of the binding mechanism 18 when the binding edge 14 and bindable edge 19*b* are aligned with each other. For example, the gripping portion 35 can be recessed inward with respect to the bindable edge 17*b* to facilitate gripping. The gripping portion 35 also decreases the number of receiving portions 27 that need to be disengaged from the binding members 11. Thus, less effort, less force, and fewer receiving portions 27 are required compared to the binding edge 14, which is more securely bound to the binding mechanism 18.

In some configurations, the side edge 19*a* of cover member 13, can remain generally flat and continuous, as in notebook 10. Alternatively, the cover member 13 can also be expandable and have a bindable edge similar to that of the cover member 17 described in FIGS. 6*a* and 6*b*.

The expandable cover member 17 can be moveable between two positions: a folded position and unfolded position. In the folded position, the inner expandable portion 17*b* is folded over the hinge 33, as indicated by arrow "b" in FIG. 6*a*, such that the inner expandable portion 17*b* lays on the outer expandable portion 17*a* and the inside surface of the inner expandable portion 17*b* faces, or in some embodiments against, the inside surface of the outer expandable portion 17*a*. In the folded position, the receiving portions 27 of the sheet binding portions 70 along the bindable edge 19*b* is brought into proximity and alignment with the binding edge 14 and binding members 11. The bindable edge 19*b*, in some embodiments, can be coaxial with the binding edge 14, and in some embodiments, with the hinge axis 68 when in the folded position. When the inner expandable portion 17*b* is fully folded over on the outer expandable portion 17*a* at the hinge 33, the receiving portions 27 disposed along the bindable edge 19*b* can engage with the binding members 11. Preferably, the inner expandable portion 17*b* engages the same binding mechanism 18 as the binding edge 14 of the outer expandable portions 17*a*. In this manner, the inner expandable portion 17*b* and outer expandable portion 17*a* form the second expandable member 17, and the notebook 60 can function in the manner of notebook 10 in a folded state (FIG. 6*b*), with a first and second cover members for simply enclosing sheets 16 therebetween. In other embodiments, the bindable 19*b* and binding edges 14 engage different binding mechanisms 18 when in the folded position.

The cover member 17 can be expanded by gripping the bindable edge 19*b* or the recessed gripping member 35, separating the binding members 11 from the receiving portions 27 disposed on the bindable edge 19*b*, and unfolding along hinge 33, as indicated by arrow "a" in FIG. 6*b*. In the fully unfolded state, the inner expandable portion 17*b* can be adjacent to, but not over, the outer expandable portion 17*a* and the bindable edge 19*b* of the inner expandable portion 17*b* extends away from the binding mechanism 18. When the expandable cover member is in the unfolded position (FIG. 6*a*), the two expandable portions 17*a*, 17*b* can reveal pockets 36,37 for holding additional items.

Other expandable sheet member 15 shapes can be used. In some embodiments, other configurations of the expandable sheet members 15 can be used with other locations of the bindable 19*b* and binding edges 14 along sheet member 15 and with a hinge 33 being positioned between the bindable 19*b* and binding edge 14 such that when the sheet member 14 is folded, the bindable 19*b* and binding edges 14 are in condition to engage binding members 11. Preferably, the bindable edges 19*b* are disposed to extend away from the hinge 33 and binding mechanism 18 in the unfolded position, but in other configurations, the bindable edges 19*b* can extend in different directions.

In other embodiments, the expandable sheet member 15 as described can have other types of binding mechanisms 18, and is not limited to notebooks having a binding member 11 with two disk ring portions 21, 22 shown in FIGS. 3*a*-3*e*. Instead, the expandable sheet member 15 can be used in other binding systems, for example, ring binders, standard spiral notebooks, and other similar books.

In some embodiments, one or more tabs 47 may be provided with notebooks 10 or 60. Tabs may be removably adhesively securable to any portion of such notebook, and may further a further means for making or otherwise indicating particular sheets 16, etc. A tab 47 is shown adhered to the cover member 13 in FIG. 16. Tabs may be of various colors and sizes, as is known in the art. A portion of one side of such tab 47 may include an adhesive, for effecting the removable adhesive securement, as is also known in the art.

Any and all references specifically identified in the specification of the present application are expressly incorporated herein in their entirety by reference thereto. The term "about," as used herein, should generally be understood to refer to both the corresponding number and a range of numbers. Moreover, all numerical ranges herein should be understood to include each whole integer within the range.

While illustrative embodiments of the invention are disclosed herein, it will be appreciated that numerous modifications and other embodiments may be devised by those skilled in the art. For example, the features for the various embodiments can be used in other embodiments. Therefore, it will be understood that the appended claims are intended to cover all such modifications and embodiments that come within the spirit and scope of the present invention.

What is claimed is:

1. A booklet comprising:

a plurality of binding members coaxially aligned to form a booklet hinge, the binder members including:

a first disk ring portion configured for reception in a first binding recess of sheet members, the first disk ring portion has an inner surface that faces radially inward for engaging and retaining a first binding protrusion of the sheet members for binding the sheet members;

a second disk ring portion configured for reception in the first binding recess of the sheet members, the second disk ring portion has an inner surface that faces radially inward for engaging and retaining a second binding protrusion of the sheet members for binding the sheet members; and an axial extension member associated with the first disk ring portion and extending generally in an axial direction with respect thereto, wherein the second disk ring portion is connected to the axial extension on an opposite side thereof from the first ring portion, wherein the first disk ring portion and the second disk ring portion are associated for cooperatively maintaining the first binding protrusion and the second binding protrusion engaged thereto and are configured for allowing the bound sheet members to slide around the first disk ring portion and the second disk ring portion while retaining the engagement; and a sheet binding portion of the sheet members for receiving and engaging to the binding members such that the sheet members are slidable around the binding members to move the sheet members around the booklet hinge, wherein the sheet binding portion defines binding recesses for receiving the binding members, such that the sheet member can be flipped around the binding members to turn the sheet member, wherein at least one of the sheet members is an expandable sheet member that includes a first sheet member portion having a binding edge and a second sheet member portion having a bindable edge opposite the binding edge, the first sheet member portion and the second sheet member portion hinged to each other at the intra-sheet hinge disposed between the binding edge and bindable edge, wherein at least one of the binding recesses is disposed on the binding edge and the bindable edge for engaging the binding members, and wherein the bindable edge has fewer of the binding recesses than the binding edge for easier engagement and disengagement of the bindable edge to the binding members coaxially aligned to form the booklet hinge.

2. The booklet of claim 1, wherein the axial extension has a smaller diameter than a diameter of the first disk ring portion and the second disk ring portion to define a channel therebetween.

3. The booklet of claim 2, wherein a depth of the channel is between about ¼ and ½ the diameter of the first disk ring portion and the second disk ring portion.

4. The booklet of claim 1, wherein the first disk ring portion and the second disk ring portion further comprise a rim that includes the inner surface for engaging and retaining the first binding protrusion and the second binding protrusion, respectively.

5. The booklet of claim 4, wherein the axial extension member is disposed coaxially with the rim.

6. The booklet of claim 4, wherein the first disk ring portion and the second disk ring portion further comprise a recessed area disposed radially inward of the rim, the rim extending radially and axially outward beyond the recessed area.

7. The booklet of claim 1, wherein:

the axial extension member has an axial width;

the first ring portion has a diameter; and the ratio of the axial width to the diameter is greater than about 3/4.

8. The booklet of claim 1, wherein the sheet members comprise first and second covers and a stack of pages therebetween receiving the binding members in the recesses, such that the sheet members can be flipped around the binding members to turn the covers and pages.

9. The booklet of claim 1, wherein the booklet comprises a notebook.

10. The booklet of claim 1, wherein the second sheet member portion is moveable between:

a folded position, wherein the second sheet member portion is folded over the first sheet member portion at the intra-sheet hinge such that the bindable edge of the second sheet member portion is aligned with the binding edge of the first sheet member portion; and an unfolded position, wherein the bindable edge of the second sheet member portion extends away from the binding edge of the first sheet member portion.

11. The booklet of claim 10, wherein the binding recesses disposed along the bindable edge of the second sheet member portion engages the binding members in the folded position.

12. The booklet of claim 11, wherein the binding recesses of the bindable edge can engage to the same binding members as the binding recesses of the binding edge when in the folded position.

13. The booklet of claim 1, wherein the second sheet member portion is a cover member.

14. The booklet of claim 13, further comprising a gripping member disposed along the bindable edge configured to facilitate disengaging the second sheet member portion from the binding members.

15. An expandable sheet member comprising:

a first sheet member having a binding edge and a second sheet member having a bindable edge opposite the binding edge, the first sheet member and the second sheet member hinged to each other at an intra-sheet hinge disposed between the binding edge and the bindable edge;

a binding mechanism; and a sheet binding portion defining binding recesses being disposed on the binding edge and the bindable edge configured for receiving and engaging with the binding mechanism, the binding mechanism is to allow the first sheet member to slide around the binding mechanism while engaging the binding mechanism to enable the first sheet member to be flipped around the binding mechanism to turn the first sheet member, wherein the bindable edge has fewer of the binding recesses than the binding edge for easier engagement and disengagement of the binding mechanism.

* * * * *